United States Patent [19]

Inada

[11] Patent Number: 4,618,145

[45] Date of Patent: Oct. 21, 1986

[54] PHYSICAL TRAINING APPARATUS

[76] Inventor: Taichi Inada, 120-banchi, 1-chome, Niwai-chou, Sumiyoshi-ku, Osaka City, Japan

[21] Appl. No.: 715,968

[22] Filed: Mar. 25, 1985

[51] Int. Cl.[4] ..... A63B 21/00

[52] U.S. Cl. ..... 272/146; 272/33 R; 272/36

[58] Field of Search ..... 272/146, 145, 144, 109, 272/97, 33 R, 38, 36, 50, 49

[56] References Cited

U.S. PATENT DOCUMENTS

| | | | |
|---|---|---|---|
| 2,144,206 | 1/1939 | Thompson | 272/36 X |
| 3,141,669 | 7/1964 | Chul | 272/33 R |
| 3,164,382 | 1/1965 | Johnson | 272/33 R |
| 3,276,777 | 10/1966 | Pruitt, Sr. | 272/33 R |
| 3,704,885 | 12/1972 | Raciunas | 272/97 |
| 3,834,693 | 9/1974 | Poppenberger | 272/97 |
| 3,936,047 | 2/1976 | Brandt et al. | 272/146 |
| 4,113,250 | 9/1978 | Davis | 272/93 |

FOREIGN PATENT DOCUMENTS

| | | | |
|---|---|---|---|
| 982576 | 6/1951 | France | 272/36 |
| 1159660 | 2/1958 | France | 272/36 |

*Primary Examiner*—Richard J. Apley
*Assistant Examiner*—David J. Brown
*Attorney, Agent, or Firm*—Thomas R. Vigil

[57] ABSTRACT

A physical training apparatus includes a support frame, a horizontal member pivotally and rotatably mounted to the support frame and a vertical member rotatably mounted on the horizontal member, while on the lower portion of the vertical member there is a revolving disc which is slidable on the vertical member and rotatable about a central axis thereof.

6 Claims, 9 Drawing Figures

PHYSICAL TRAINING APPARATUS

BACKGROUND OF THE INVENTION

This invention relates generally to an apparatus used for physical exercise and, in particular, to a physical training apparatus with which the user can simulate movement like an astronaut performs in a weightless environment.

Prior to this invention, though there are many physical training apparatus available on the market, most of them are only capable of exercising one portion of the body, such as apparatus for upper limbs, lower limbs, loins, or abdomen, and the like, which cannot be used for training the whole body. In addition, they can only perform regulated movements, and therefore the user may feel bored when exercising with a conventional apparatus.

SUMMARY OF THE INVENTION

Therefore, it is a general object of this ivention to provide a physical training apparatus for the exercise of the whole body.

According to the present invention, there is provided a physical training apparatus, comprising a supporting frame including a pair of spaced-apart side supports; a first member having two first ends thereof pivotably connected to the pair of side supports respectively; a second member having two second ends pivotably connected to the first member; and a foot plate mounted on the second member and slidable and rotatable relative thereto.

In a preferred embodiment of this invention, the first member is a first rectangular frame, and the second member is a U-shaped frame having two free ends rotatably suspended from the first member.

Alternatively, the second member can be a second rectangular frame rotatable about an axis transverse to the first member and the first member is a horizontal bar extending between the pair of spaced-apart side supports.

In a further embodiment, the second member is an arcuated frame with two ends pivotably connected to the side supports respectively and rotatable about the identical axis of rotation of the first member.

BRIEF DESCRIPTION OF THE ACCOMPANYING DRAWINGS

DETAILED DESCRIPTION OF THE PREFERRED EMBODIMENTS

Figure 1:
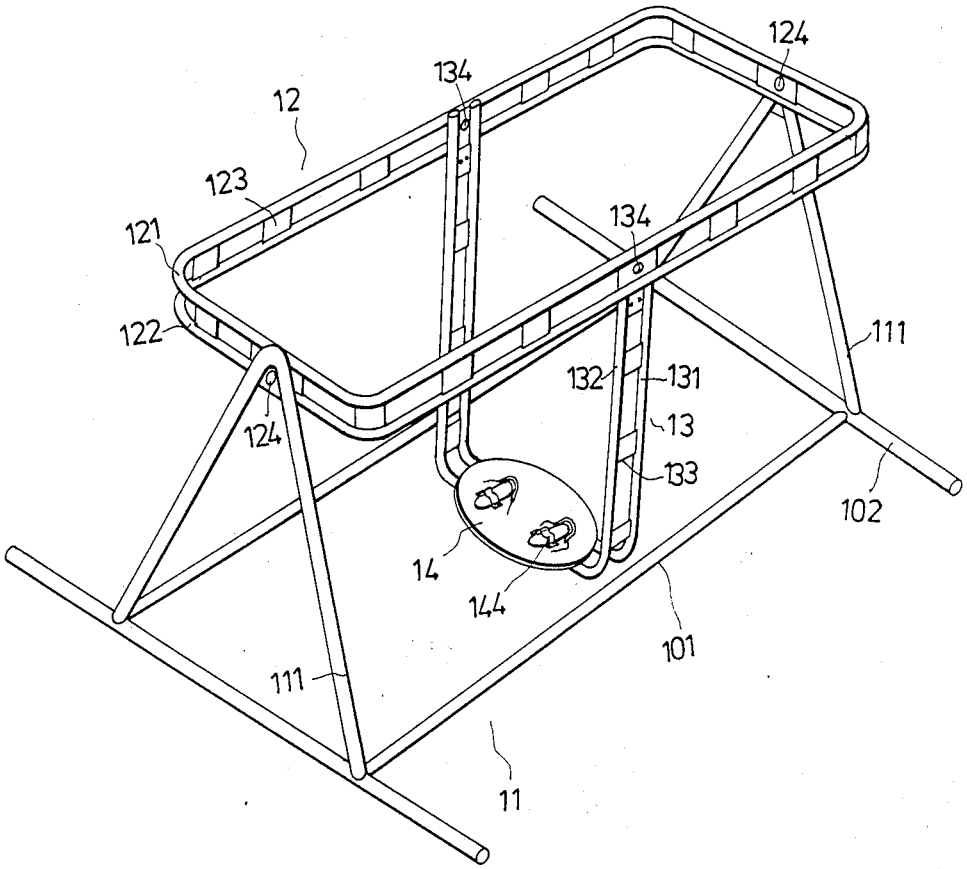
FIG. 1 is a perspective view of the physical training apparatus of a first embodiment according to this invention.

Referring now to FIG. 1 which shows the first embodiment of this invention, consisting of a supporting frame 11, with a substantially rectangular base formed of a pair of longitudinally extending members 101, 101 and a pair of transverse members 102, 102. The supporting frame also includes a pair of spaced-apart side supports 111, 111 each consisting of a pair of braces which extend upward from members 102, 102 and form an isosceles triangle with the transverse members 102 respectively. The rectangular base has a large base area to provide the apparatus with sufficient stability.

The horizontal member is formed by a rectangular frame 12 consisting of upper and lower members 121, 122 and a plurality of vertical studs 123 for connecting the two, with the shorter sides mounted to the top ends of the side supports 111, 111 and rotatable relative thereto about an axis parallel with the longitudinal direction of the rectangular frame 12.

A U-shaped member 13 is pivotally suspended from the intermediate portion of the longer sides of the rectangular frame 12, and capable of swinging about the pivotal connection 134, which will be described in detail hereinafter, when a force is applied thereto by the user. Similar to the horizontal member 12, the U-shaped member 13 is also formed by a pair of metal tubings 131, 132, and a plurality of studs 133 for connecting the two. On the transverse portion of the member 13, there is mounted a revolving disc 14.

Figure 7:
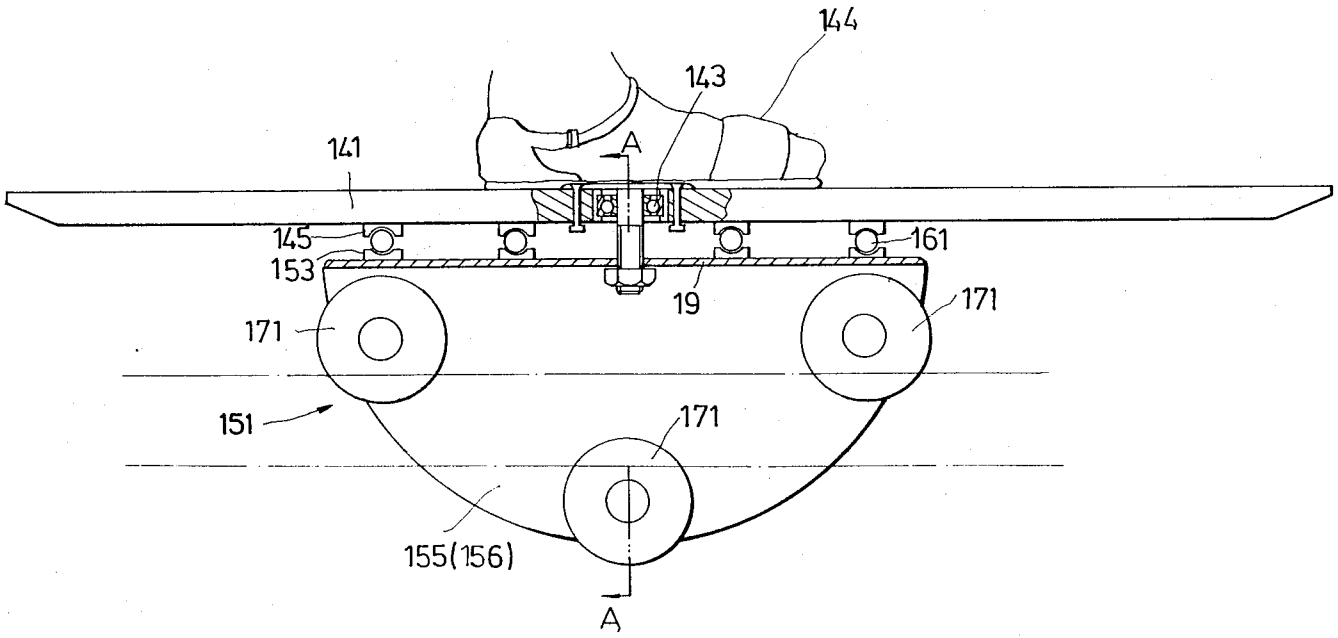
FIG. 7 is a schematical side view of the foot plate of the first, second and third embodiments.
Figure 8:
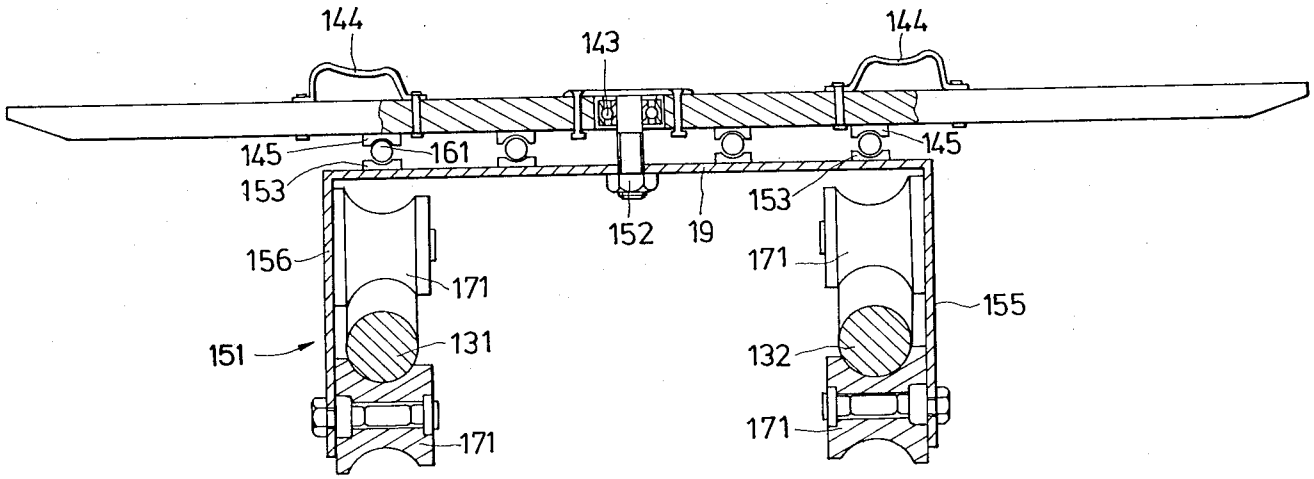
FIG. 8 is a transverse vertical section view taken along lines A—A of FIG. 7.

With respect to the structure of the revolving disc 14, please refer to FIGS. 7 and 8, which show that it comprises a foot plate 141 connected by a ball bearing 143 and a bolt 152, with a member 151 disposed thereunder, and the member 151 has a surface 19 confronting the lower surface of the foot plate 141, on which is provided a plurality of seats 153, each defined with a concave surface. In addition, on the under surface of the foot plate 141 there are a plurality of seats 145 disposed at corresponding positions with the seats 153 and each of them is formed with a similar concave surface. It should be noted that the seats 145 and 153 are disposed around two circles on the foot plate 141 and the member 151, and between each two corresponding seats 145, 153 there is a rolling ball 161 placed which enables the foot plate 141 and the member 151 to rotate with respect to each other with the cooperation of the ball bearing 143, when the user, standing on the disc 14, twists his body.

The member 151 has two side walls 155, 156 of a substantially semicircular shape, and with respect to each wall, there are three pulleys 171 pivotally mounted to the periphery from the inside thereof, as can be seen in FIG. 8. The two upper pulleys on each side are retained on the U-shaped tubing 131(132) from the lower side, while the lower pulley is engaged with the tubing 131(132) from the upper side thereof. Therefore, the revolving disc 14 can slide on the transverse portion of the U-shaped member 13 if the user standing on the disc 14 twists his body.

Figure 2:
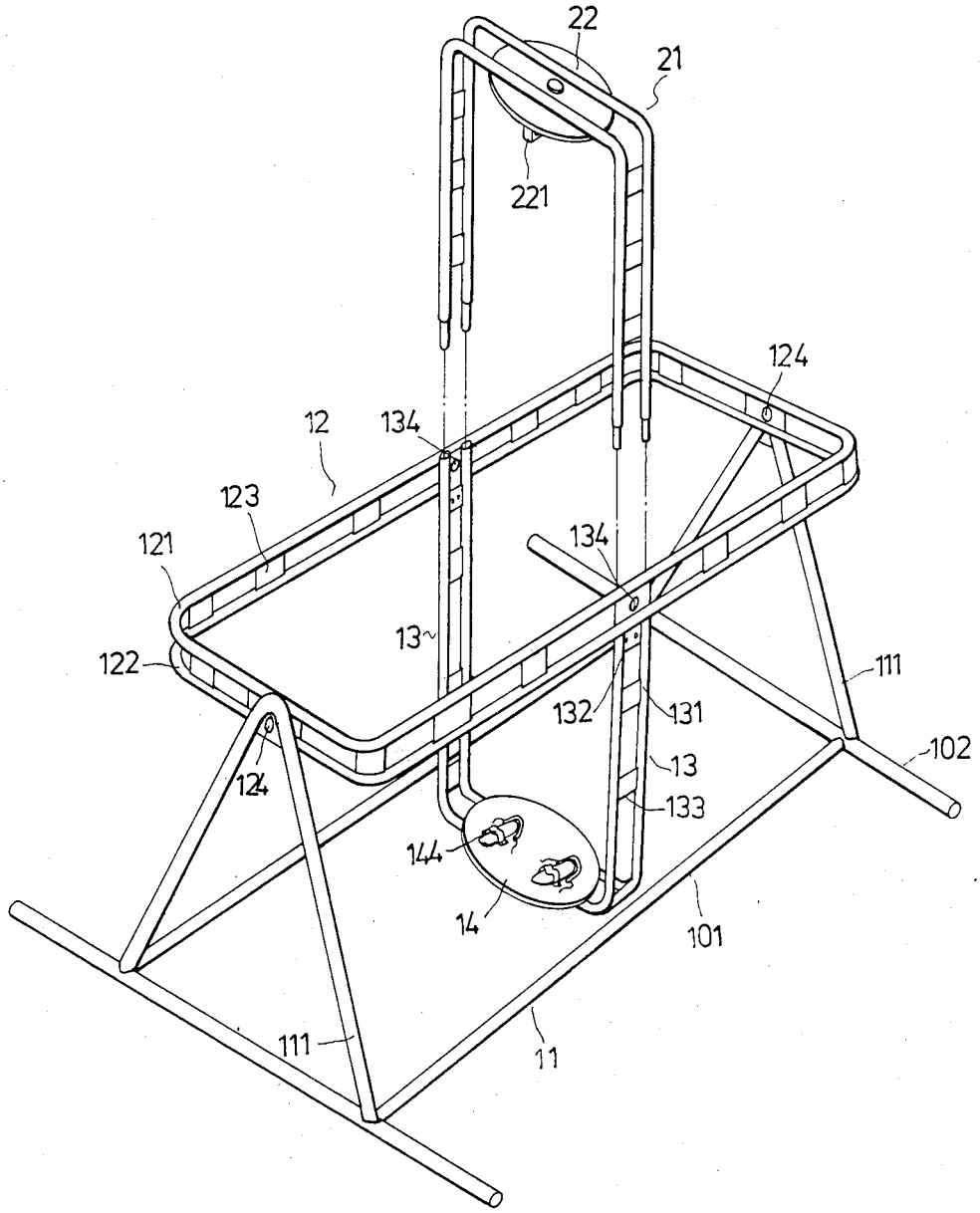
FIG. 2 is a schematic view of the physical training apparatus of a second embodiment of this invention.
Figure 3:
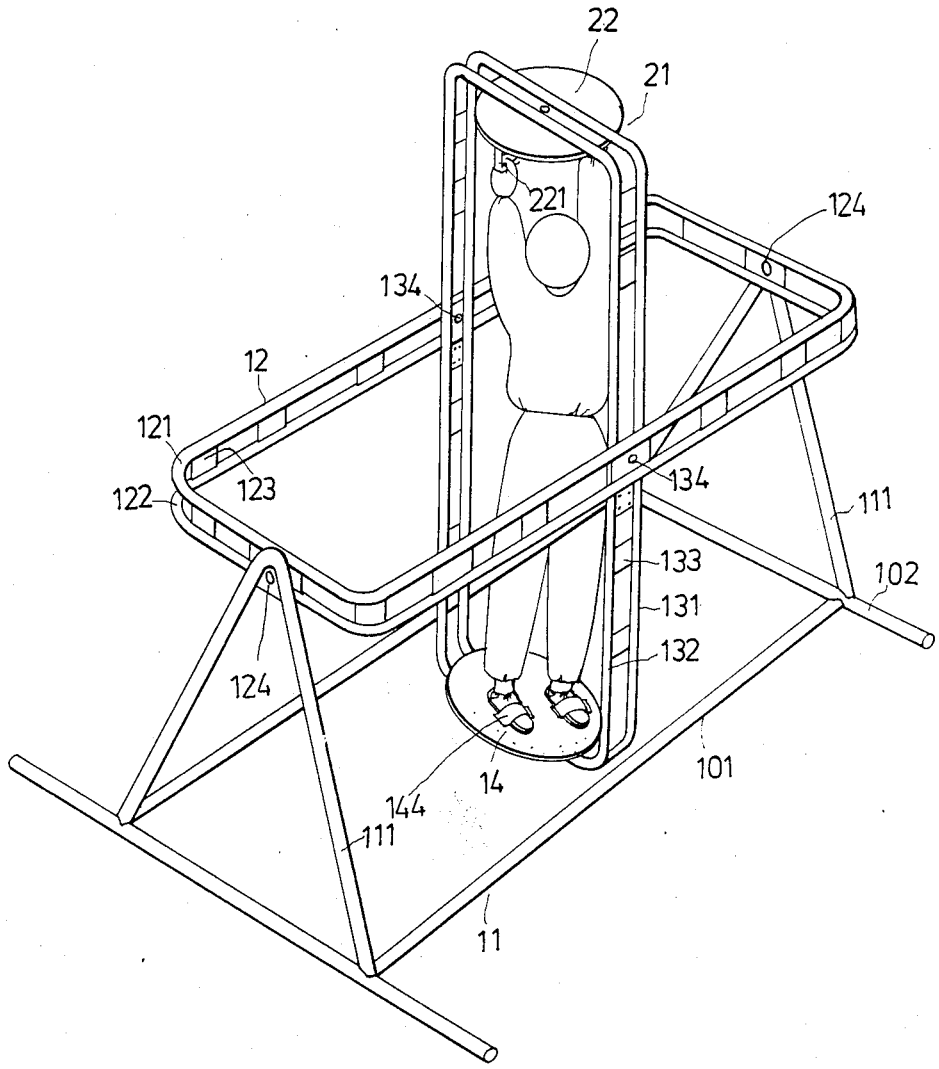
FIG. 3 is a perspective view of the physical training apparatus as shown in FIG. 2.

A second embodiment of the present invention is shown in FIG. 2 in which the like members are indicated by the same numerals as those in the FIG. 1. In this embodiment, there is an additional identical U-shaped member 21 fixed to the member 13 thereby providing a rectangular frame, and on the top end of the additional member 21 there is a disc member 22 having a loop 221 for being gripped by the hand of the user, while his feet are strapped into the footholds 144 to prevent them from moving off the disc 14, He can make the rectangular frame, comprised of upper and lower members 21 and 13, rotate about the pivotal connection 134 by swinging his body.

When the user freely and violently moves his body on the physical training apparatus according to this invention, the apparatus makes several kinds of movements, for example, the revolving and sliding movements of the disc 14, and the rotating of horizontal member 12 and the U-shaped member 13, which occur simultaneously. The traces of the movements are determined by the force exerted and the types of movements performed, which is a quality unexpected by the user, and provides a lot of fun to one who is exercising with this training apparatus.

Figure 5:
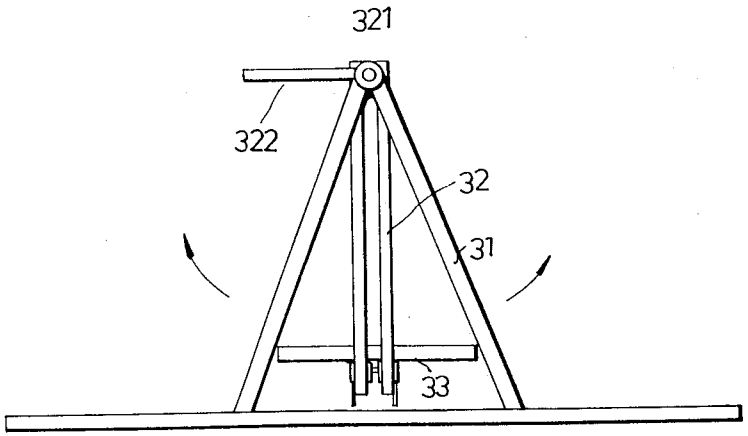
FIG. 5 is a right side view of the physical training apparatus as shown in FIG. 4.
Figure 6:
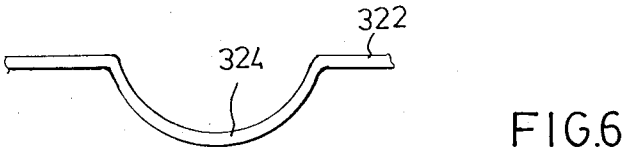
FIG. 6 is a top view of the horizontal bar of the physical training apparatus as shown in FIG. 5.
Figure 4:
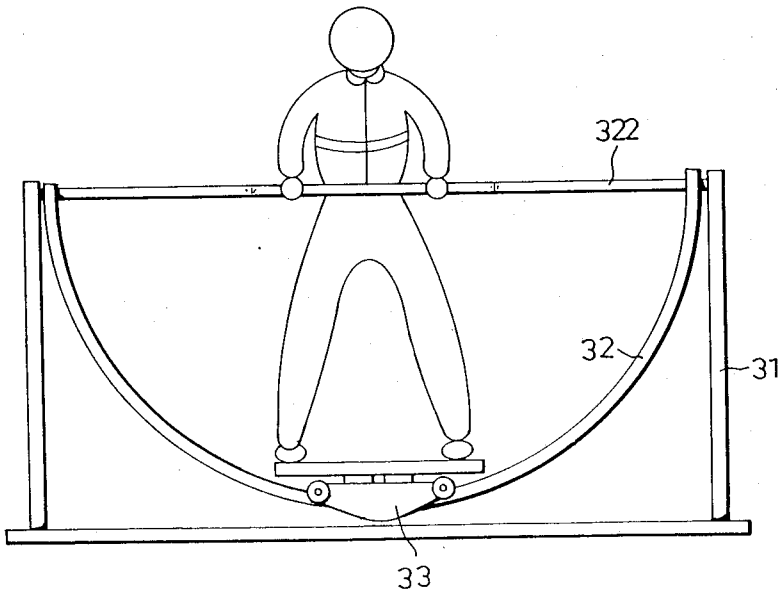
FIG. 4 is a front view of the physical training apparatus of a third embodiment of this invention.

A further embodiment is shown in FIGS. 5 and 6, and includes a supporting frame 31 similar to that of the first and second embodiments, as well as a suspended arcuated frame 32 consisting of a pair of metal tubes 323, 323 which are pivotally connected to the side supports 31, 31 and a horizontal bar 322 which extends between the two ends of the arcuate frame 32, with two ends thereof connected to the side supports 31, 31. A revolving disc 33 of similar construction as that of the first and second embodiments is supported on the lower portion of the arcuated frame 32 and is slidable thereon with the movement of the human body.

It is seen in FIGS. 5 and 6 that the horizontal bar 322 has a curved portion 324 formed as a gripping portion for the user, and his body can be recessed therein when he stands on the revolving disc 14. With this structure, the user can make the arcuated frame 32 rotate about the pivotal connection 321, as shown in FIG. 5, and similarly the revolving disc 33 can revolve about a vertical axis and is slidable within a curved path on the arcuated frame 32.

Figure 9:
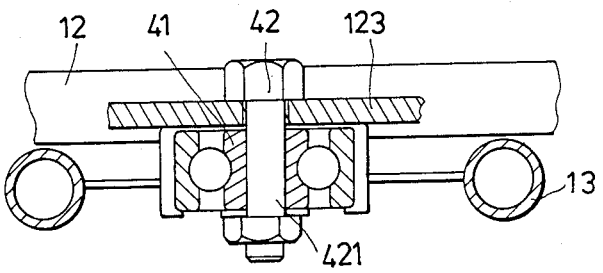
FIG. 9 is a vertical section view of the pivotal connection of the horizontal and vertical frames of the physical training apparatus according to this invention.

Preferably, in order to make the rotation of the horizontal member 12 and the U-shaped frame 13 shown in FIG. 1 more smooth, ball bearings 41 can be used in the pivotal connections 124 and 134, which axially conform to the axes of rotation of the horizontal member 12 with respect to the side supports 111, and the U-shaped frame 13 with respect to the horizontal member 12. The mounting of bearings 41 is illustrated in FIG. 9, where with respect to the pivotal connection 134, the bearing 41 is disposed between the horizontal member 12 and the U-shaped frame 13, and secured with them by means of a riveting device 42 with a shank 421 thereof penetrating the stud 123 of the horizontal member 12, as well as the bearing 41 and the stud 133 of the U-shaped frame 13. The bearing of the pivotal connection 124 is mounted in a similar manner.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the appended claims which scope is to be accorded the broadest interpretation so as to encompass all such modifications and equivalent structures.

I claim:

1. A physical training apparatus comprising:

a supporting frame including a pair of spaced-apart side supports;

a first member having two first ends thereof pivotably connected to said pair of side supports respectively;

a second member having two second ends pivotably connected to said first member; and a foot plate mounted on said second member and provided with a bearing member at the center thereof, a pair of footholds, a bracket having opposite downwardly extending walls which are fastened with said foot plate, with a space left between said bracket and said foot plate, a plurality of rolling ball elements provided between said foot plate and said bracket, and a plurality of pulleys mounted inside of said downwardly extending walls to provide a foot plate which is slidably and rotatably engaged with said second member.

2. A physical training apparatus as claimed in claim 1, wherein said first member is a first rectangular frame.

3. A physical training apparatus as claimed in claim 2, wherein said second member is a U-shaped frame having two free ends rotatably suspended from said first member.

4. A physical training apparatus as claimed in claim 2, wherein said second member is a second rectangular frame rotatable about an axis transverse to said first member.

5. A physical training apparatus as claimed in claim 1, wherein said first member is a horizontal bar extending between said pair of spaced-apart side supports.

6. A physical training apparatus as claimed in claim 5, wherein said second member is an arcuated frame with two ends pivotably connected to said side supports respectively and is rotatable about the identical axis of rotation of said first member.

* * * * *